US005779129A

United States Patent [19]

Herbst et al.

[11] Patent Number: 5,779,129

[45] **Date of Patent: *Jul. 14, 1998**

[54] CONTAINER HAVING A BOX BLANK WITH REMOVABLY ATTACHED LID BLANK

[75] Inventors: John E. Herbst, Bolingbrook; Joseph J. Benes, Arlington Hts., both of Ill.

[73] Assignee: Fellowes Manufacturing Company, Itasca, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 794,193

[22] Filed: Jan. 24, 1997

[51] Int. Cl.[6] ..... B65D 5/42

[52] U.S. Cl. ..... 229/125.19; 229/23 BT; 229/935; 229/937

[58] Field of Search ..... 229/23 BT, 125.19, 229/23 A, 900, 933, 934, 935, 936, 937

[56] References Cited

U.S. PATENT DOCUMENTS

| | | | |
|---|---|---|---|
| 1,198,032 | 9/1916 | Henze | 229/936 |
| 1,367,378 | 2/1921 | Gruenberg | 229/125.19 |
| 3,145,904 | 8/1964 | Bromley . | |
| 3,235,166 | 2/1966 | Guyer | 229/125.19 |
| 3,533,547 | 10/1970 | Houston . | |
| 3,536,249 | 10/1970 | Houston . | |
| 3,883,067 | 5/1975 | McGlynn et al. . | |
| 3,926,362 | 12/1975 | Beck et al. | 229/125.19 |
| 4,046,314 | 9/1977 | Hill . | |
| 4,089,458 | 5/1978 | Meyers et al. . | |
| 4,142,665 | 3/1979 | Jewell et al. . | |
| 4,174,051 | 11/1979 | Edwards et al. . | |
| 4,238,069 | 12/1980 | Morris, Jr. . | |
| 4,249,693 | 2/1981 | Diaz . | |
| 4,272,009 | 6/1981 | Bamburg et al. | 229/23 BT |
| 4,314,642 | 2/1982 | Dagostine . | |
| 4,452,367 | 6/1984 | Wein | 29/125.19 |
| 4,927,074 | 5/1990 | LaRue et al. . | |
| 5,007,580 | 4/1991 | Morrison et al. . | |
| 5,579,989 | 12/1996 | Roy et al. . | |

*Primary Examiner*—Gary E. Elkins
*Attorney, Agent, or Firm*—Brinks Hofer Gilson & Lione; G. Peter Nichols

[57] ABSTRACT

A container constructed from a cut and scored foldable blank of cardboard or similar material which includes a box blank, which when folded defines a box having four sides extending upward from a bottom to define an open top and a lid blank that is removably secured to the box blank, which when removed and folded defines an enclosure for the open top.

5 Claims, 4 Drawing Sheets

CONTAINER HAVING A BOX BLANK WITH REMOVABLY ATTACHED LID BLANK

The present invention relates to a container made from paperboard or cardboard stock material. The container is formed from a box blank and a removably attached lid blank. The box blank, when folded, defines a rectangular box that has an open top, two-layer side walls and a two-layer bottom. The lid blank, when removed from the box blank and folded, defines an enclosure for the open top.

BACKGROUND OF THE INVENTION

Corrugated cardboard box blanks are well known. Typically, the box blank is shipped to the customer, who assembles the blank to form a box. Usually, separate lid blanks are shipped to the customer with the box blanks so that the customer can, if they wish, assemble the lid blank to form a lid to complement the box. Unfortunately, customers often do not assemble the lid at the same time as the box and the lid is lost or misplaced. As a result, the customer must obtain another lid blank from the manufacturer. Consequently, the cost to the customer for a complete box and lid is increased.

To date, a satisfactory solution to the above problem has not been proposed. The present invention, however, provides a cost-effective and, in hindsight, a simple solution to the problem by providing a container comprising a box blank and a removably attached lid blank to form an integral box-lid unit.

SUMMARY OF THE INVENTION

The present invention therefore includes a container that is formed from a box blank that when folded defines a box having four sides extending upward from a bottom to define an open top and a lid blank removably secured to the box blank. When the lid blank is removed from the box blank and folded, it defines a removable lid for enclosing the top.

Preferably the box and lid blanks are constructed from a pre-slit and pre-scored planar blank, which is preferably cardboard or corrugated cardboard. Score lines are lines inscribed in the surface of the blank to facilitate folding, where such lines do not form complete or partial cuts through the material.

While the present invention is suitable for a number of foldable containers such as non-glue joint boxes and glue joint boxes, for ease of description the present invention will be described with respect to one embodiment of the invention, a glue-joint box type.

DESCRIPTION OF THE PREFERRED EMBODIMENTS

Figure 1:
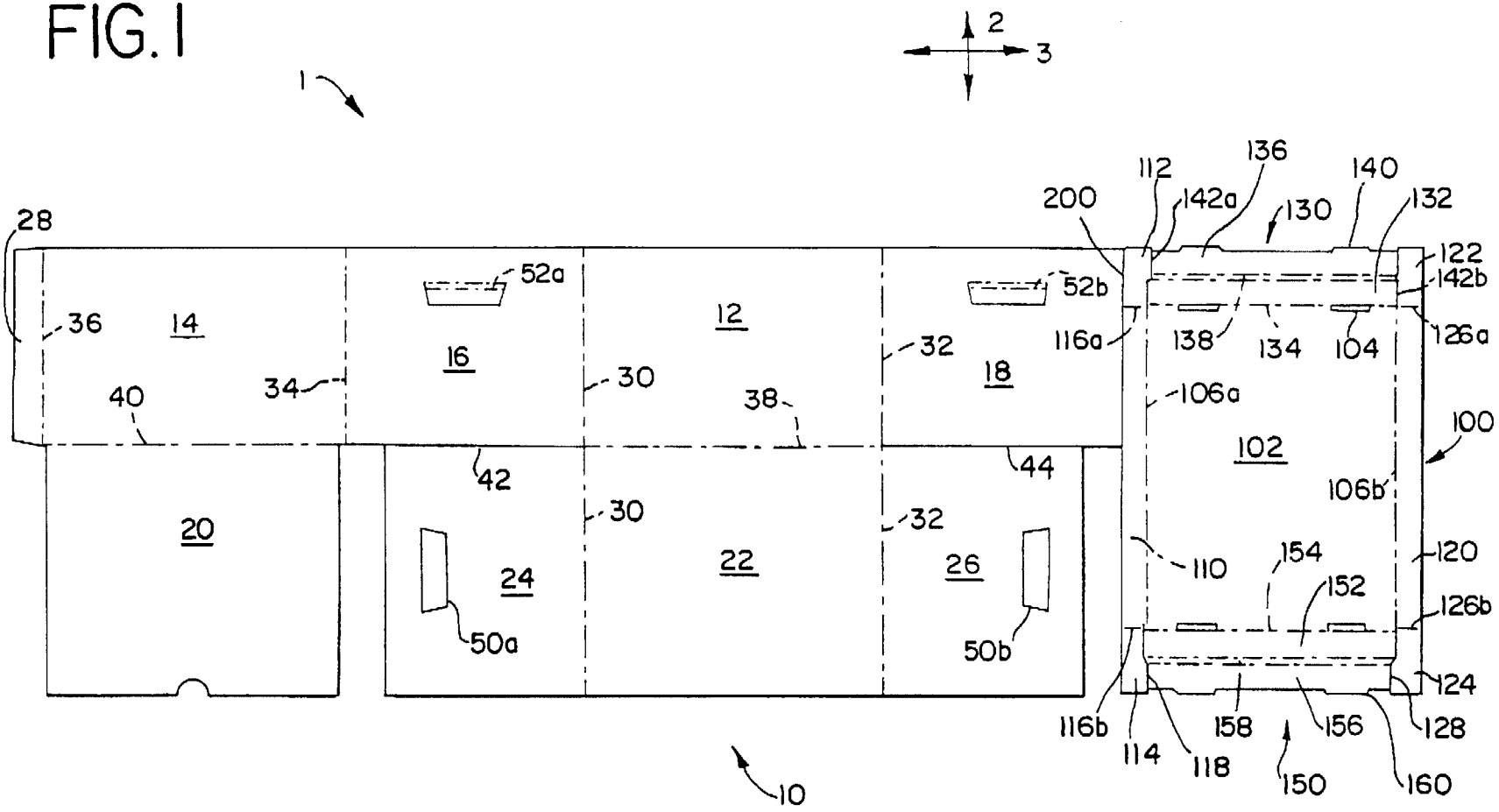
FIG. 1 is a top plan view of one embodiment of the box blank and the removably attached lid blank.

With reference to FIG. 1, a container may be formed from a blank of the present invention with the blank shown in the unfolded state. For ease of description two primary directions of the blank will be designated as longitudinal 2 and lateral 3. The blank includes a box blank 10 and a lid blank 100, which is removabley attached to the box blank.

The box blank 10 includes a front wall 12, a back wall 14, a first outer side wall 16, a second outer side wall 18, an inner bottom panel 20, an outer bottom panel 22, a first inner side wall 24, a second inner side wall 26, and a flange 28. The front wall 12 is connected by longitudinal score line 32 to the second outer side wall 18. As used herein, score lines are lines inscribed in the surface of the box and lid blanks to facilitate folding and do not extend through the thickness of the blank. The front wall is also connected by longitudinal score line 30 to the first outer side wall 16, which is connected to the back panel 14 by longitudinal score line 34. The front wall is also connected by lateral score line 38 to the outer bottom panel 22. The outer bottom is connected by longitudinal score line 30 to the first inner side wall 24 and by longitudinal score line 32 to the second inner side wall 26. The first inner side wall 24 is also connected to the first outer side wall by lateral slits 42. Likewise, the second inner side wall 24 is connected to the second outer side wall 18 by lateral slits 44.

As used herein, the term slits includes a complete cut through the thickness of the blank either intermittently or continuously along its length. It will be understood that where the slits are intermittent, the first inner and outer side walls will be removably joined. Preferably, the lateral slits 42 and 44 are intermittent.

The back panel is connected by lateral score line 40 to the inner bottom 20. The back panel is also connected by longitudinal score line 36 to flange 28. Flange 28 is attached to the second outer side wall by any known means, preferably by adhesive. More preferably, the flange is attached to the second outer side wall prior to shipping to the customer.

To form a rectangular box, the lateral dimensions of the front and back walls are substantially equal and the lateral dimensions of the first and second outer side walls are substantially equal. In the preferred embodiment shown in FIG. 1, the second outer side wall has a lateral dimension slightly less than the lateral dimension of the first outer side wall to accommodate the attachment of the flange.

Preferably, the box blank has grip flap apertures 50*a* and 50*b*, which are openings cut into the first and second inner side walls, respectively. Grip flaps 52*a* and 52*b* are formed in the first and second outer side walls, respectively, by two score lines and three slits. The grip flap apertures 50*a* (50*b*) and grip flaps 52*a* (52*b*) are in an aligned positioned when the first (second) inner side wall and the first (second) outer side wall is in place in the folded configuration. The grip flaps are bent on the score lines and pushed through the grip flap apertures to form a comfortable grip for carrying the completed box as well as to provide a means to maintain the structure of the container.

Turning now to the lid blank 100, it includes a central portion 102, a first side wall 110, a second side wall 120, a first end wall 130, and a second end wall 150. The central portion has apertures 104 to receive tabs as will be more fully explained below. The central portion is connected by longitudinal score line 106*a* to the first side wall 110. The first side wall is connected to a first end 112 by lateral score line 116*a* and is connected to a second end 114 by lateral score line 116*b*. Each of the first and second ends have a tab 118 that, when the lid is folded, engages an aperture 104. The central portion is also connected by longitudinal score line 106*b* to the second side wall 120. The second side wall is connected to a first end 122 by lateral score line 126*a* and is connected to a second end 124 by lateral score line 126*b*. Each of the first and second ends have a tab 128 that, when the lid is folded, engages an aperture 104.

The central portion is connected by a lateral score line 134 to a first end wall 130. The first end wall 130 includes an outer end wall 132 and an inner end wall 136 connected by double score lines 138 of unequal length, such that the score line adjacent the outer end wall is longer than the score line adjacent the inner end wall. The inner end wall has a tab 140, preferably a pair of tabs that, when the lid is folded, engages an aperture 104. The first end wall is separated from the first and second ends 112, 122 of the first and second side walls by longitudinal slits 142*a* and 142*b*, respectively.

The central portion is also connected by a lateral score line 154 to a second end wall 150. The second end wall includes an outer end wall 152 and an inner end wall 156 connected by double score lines 158 of unequal length, such that the score line adjacent the outer end wall is longer than the score line adjacent the inner end wall. The inner end wall has a tab 160, preferably a pair of tabs that, when the lid is folded, engages an aperture 104. The second end wall is separated from the first and second ends 114, 124 of the first and second side walls by longitudinal slits 162*a* and 162*b*, respectively.

In accordance with the principles of the present invention, the lid blank is attached to the box blank. The lid blank can be attached in any known and suitable manner so that it can be removed from the box blank when desired. Preferably, the lid blank is attached to the box blank by intermittent longitudinal slits 200. The lid blank can be attached to the box blank in any suitable location such that when the box blank is constructed and folded for shipping, the lid blank does not unduly increase the peripheral dimensions of the box blank. Preferably, the lid blank is attached to the second outer side wall, more preferably to the portion of the second outer side wall opposite longitudinal score line 32. By attaching the lid blank in this location, when the box blank is constructed (by attaching the flange to the second outer side wall) and folded for shipping (by folding along longitudinal line 32 and longitudinal line 34), the lid blank does not laterally extend beyond box blank. In other words, the combined lateral dimension of the second outer side wall and lid blank is about the same as or slightly less than the combined lateral dimension of either the back wall and the second outer side wall or the front wall and the first outer side wall.

Figure 2B:
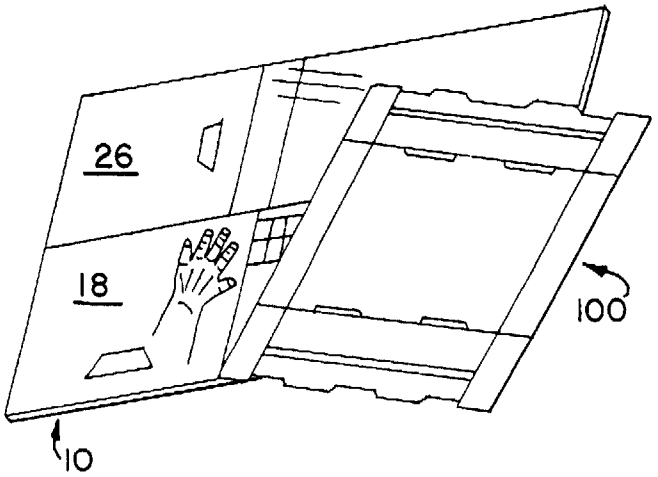
FIGS. 2*a*–2*b* is a top view of the container embodiment of FIG. 1 that shows the box blank in a partially folded state and the lid blank in an unfolded state suitable for shipping and showing removal of the lid blank.
Figure 2A:
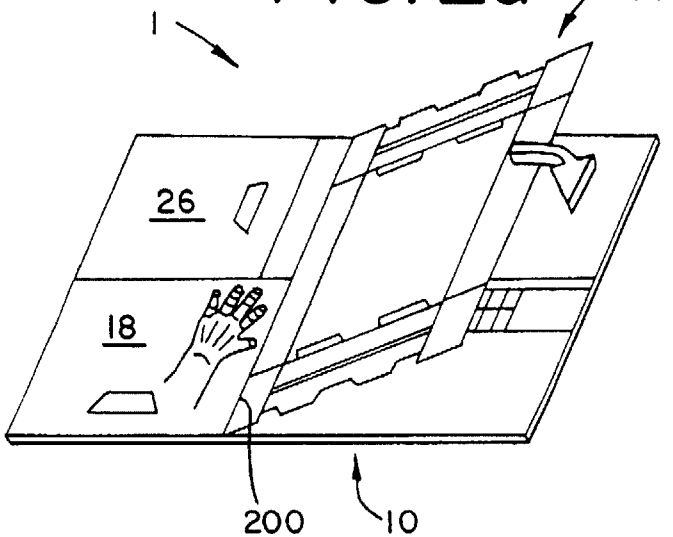

Referring now to FIGS. 2*a* and 2*b*, the container of the present invention is shown in a partially unfolded state suitable for shipping. It will be appreciated that because the lid is attached to the second outer side wall, the lid does not increase the overall dimension of the box blank when folded for shipping. To assemble the box and lid blank, the lid blank is removed from the box blank, as shown in FIGS. 2*a* and 2*b* .

Figure 3A:
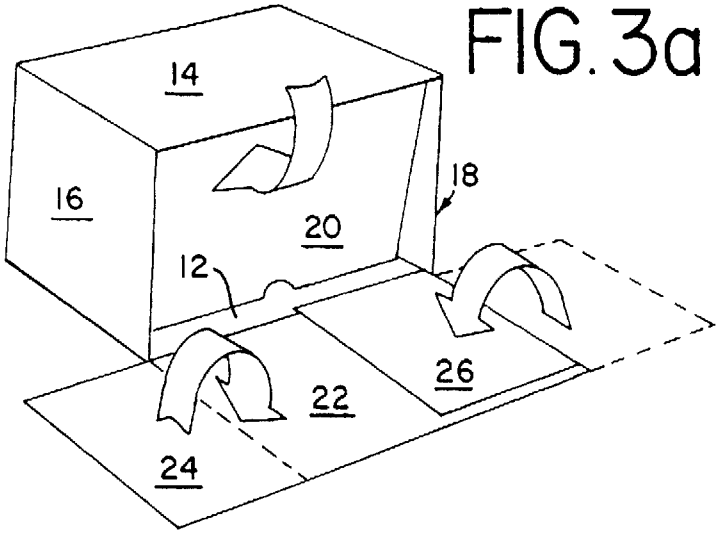
FIGS. 3*a*–3*e* are diagrammatic views of the box blank to show the manner of folding to form a box having a bottom and four walls extending upward from the bottom.
Figure 3B:
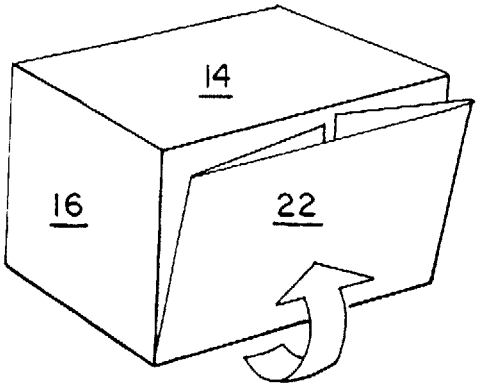
Figure 3C:
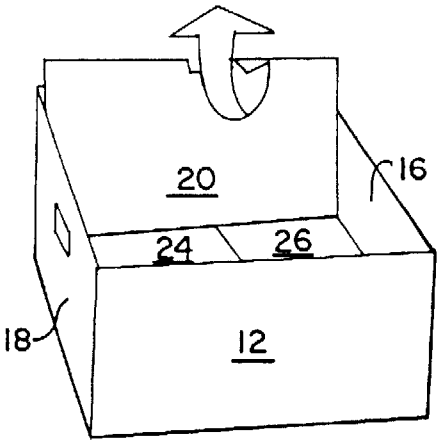
Figure 3D:
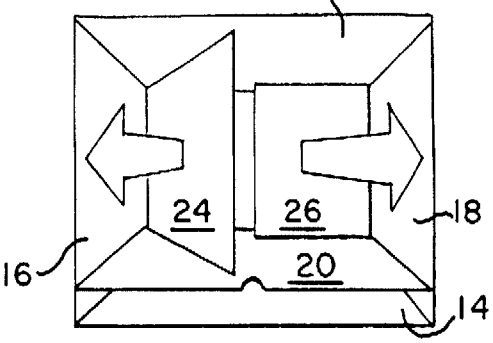
Figure 3E:
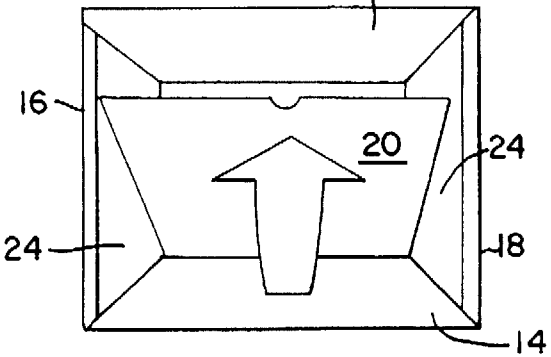

FIGS. 3*a*–3*e* diagramatically show, in sequence, the box being folded to form a box having a bottom with four walls extending upward to define an open top. The assembly will be briefly described. FIG. 3*a* shows the box blank in an open position with the inner bottom 20 being first folded inward and then the first and second inner side walls (in any order) being folded onto the outer bottom. The outer bottom, including the folded inner sides, is folded upward so that the inner side walls contact the inner bottom wall, as shown in FIG. 3*b*. The outer bottom surface is placed on a support surface and then the inner bottom is raised upwardly, as shown in FIG. 3*c*. FIG. 3*d* shows that while the inner bottom is raised upwardly, the first and second inner side walls (in no particular order) are raised upward to contact the first and second outer side walls, respectively. Then the inner bottom is downwardly depressed to complete the box.

Figure 4:
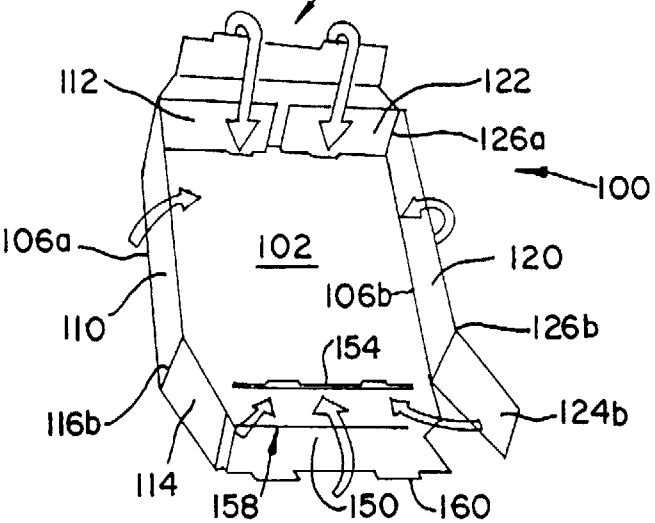
FIG. 4 is a diagrammatic view of the lid blank to show the manner of folding to form a lid to enclose the open top of the box.

FIG. 4 shows the folding of the lid blank to complete the lid. Initially, the first and second side walls are folded upward and toward the central portion. Then the first and second ends of the first and second side walls are folded inward toward the central portion until the tabs 118 and 128 engage the apertures 104. The first and second end walls (in no particular order) are folded upward and toward the central portion so that the outer end wall 132 contacts the first ends 112 and 122 and the outer end wall 152 contacts the second ends 114 and 124. Finally, the inner end walls (in no particular order) are folded downward until the tabs 140 and 160 engage the apertures.

Figure 5:
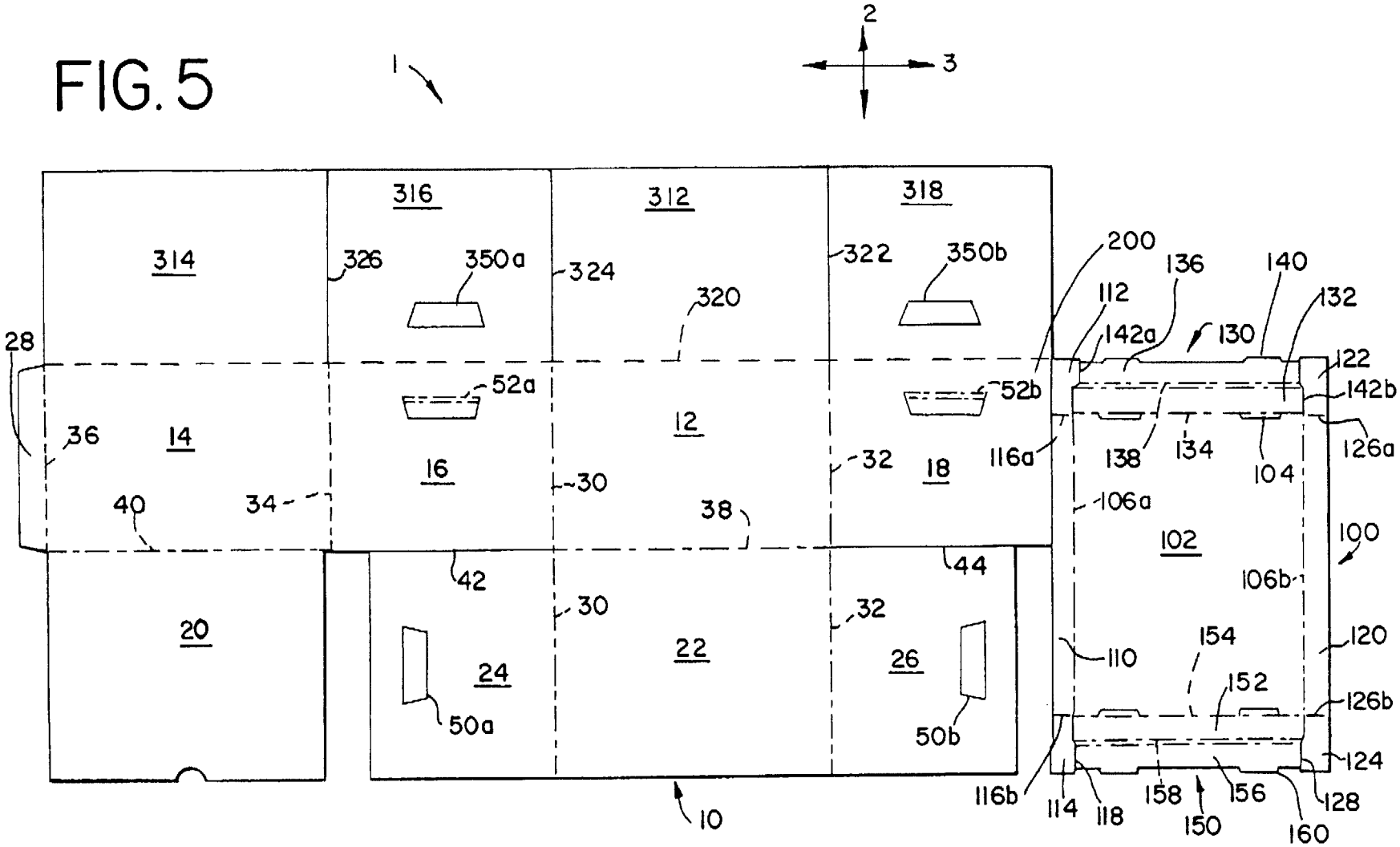
FIG. 5 is a top plan view of another embodiment of a box blank and removably attached lid blank.

FIG. 5 shows another embodiment of the container of the present invention where like numbers represent like elements, as described above. One of skill in the art will appreciate that the embodiment of FIG. 5 differs from the embodiment of FIG. 1 by the presence of an additional front panel 312, back panel 314, and side panels 316 and 318.

Each of the panels 312, 314, 316, and 318 are connected by lateral score line 320 to the front wall 12, back wall 14, first outer side wall 16, and second outer side wall 18, respectively. In addition, front panel 312 is connected by longitudinal slits 322 to side panel 318 and by longitudinal slits 324 to side panel 316. Back panel 314 is connected by longitudinal slits 326 to side panel 318. Like side panels 24 and 26, side panels 316 and 318, preferably have grip flap apertures 350*a* and 350*b*. Thus, the container of FIG. 5, will include two front and back panels, and three side panels.

The container of the present invention can be made of any suitable material, preferably material that can be cut and folded, more preferably made from paperboard or corrugated cardboard stock. The container is structured so that a cut and scored box and lid blank may be made from the planar stock material with the box and lid constructed by folding the various walls and panels in a prescribed manner. The container is self-reinforcing, having double side walls and a double panel bottom. For corrugated cardboard stock, the box blank is cut so that the corrugation flutes will be vertical in the front wall, the back wall, the two outer side walls, and horizontal in the two inner side walls. The corrugation flutes of both the inner and the outer bottom panels are in the same direction.

It should be understood that a wide range of changes and modifications can be made to the embodiments described above. It is therefore intended that the foregoing description illustrates rather than limits this invention and that it is the following claims, including all equivalents, which define this invention.

What is claimed is:

1. A blank of foldable material adapted to be separated into two portions that may be folded to form a box and a removable cover for the box, the blank comprising a. a box blank having a longitudinal direction and a lateral direction and comprising:

i. a front wall;

ii. a first outer side wall connected to the front wall by a longitudinal score line;

iii. a second outer side wall connected to the front wall by a longitudinal score line;

iv. a back wall connected to the first side wall by a longitudinal score line;

v. an inner bottom wall connected to the back wall by a lateral score line;

vi. an outer bottom wall connected to the front wall by a lateral score line;

vii. a first inner side wall connected to the outer bottom wall by a longitudinal score line; and, vii. a second inner side wall connected to the outer bottom wall by a longitudinal score line, wherein at least some of the walls define a box blank longitudinal dimension; and b. a lid blank having a portion removably secured to a portion of the box blank, wherein the lid blank does not extend beyond the box blank longitudinal dimension.

2. The blank of claim 1 wherein the lid blank has a portion removably secured to a portion of the second outer wall.

3. The blank of claim 1 further including:

a. a second front wall connected to the front wall by a lateral score line;

b. a first side panel connected to the second front wall by a longitudinal score line and connected to the first outer side wall by a lateral score line;

c. a second side panel connected to the second front wall by a longitudinal score line and connected to the second outer side wall by a lateral score line; and d. a back panel connected to the first side panel by a longitudinal score line and connected to the back wall by a lateral score line.

4. The blank of claim 3 wherein the lid blank has a portion removably secured to a portion of the second outer wall.

5. The blank of claim 1 wherein when the box blank is folded into a box and the lid blank is folded into a lid, the box has a height substantially greater than a height of the lid.

* * * * *